US005881528A

United States Patent [19]

Grewe et al.

[11] Patent Number: 5,881,528

[45] Date of Patent: Mar. 16, 1999

[54] ROUND COLUMN CLADDING SYSTEM

[75] Inventors: Ronald E. Grewe, Novi; Brian J. Hillstrom, Milford, both of Mich.

[73] Assignee: Marketing Displays, Inc., Farmington Hills, Mich.

[21] Appl. No.: 926,847

[22] Filed: Sep. 10, 1997

[51] Int. Cl.[6] ..... E04C 3/30

[52] U.S. Cl. ..... 52/721.4; 52/720.1; 52/437.1

[58] Field of Search ..... 52/720.1, 721.1, 52/721.2, 721.3, 721.4, 721.5, 301, 737.1, 736.1, 736.3, 737 A

[56] References Cited

U.S. PATENT DOCUMENTS

| | | | |
|---|---|---|---|
| 3,375,620 | 4/1968 | Phillips | 52/301 X |
| 4,040,223 | 8/1977 | Hillstrom . | |
| 4,696,136 | 9/1987 | Grewe . | |
| 4,823,533 | 4/1989 | Hillstrom . | |
| 5,150,554 | 9/1992 | Quinlan, Jr. et al. | 52/720.1 X |

FOREIGN PATENT DOCUMENTS

| | | | |
|---|---|---|---|
| 361699 | 2/1938 | Italy | 52/737.1 |
| 4-30067 | 2/1992 | Japan | 52/720.1 |
| 5-44300 | 2/1993 | Japan | 52/737.1 |

*Primary Examiner*—Creighton Smith

[57] ABSTRACT

A system for covering or cladding poles and columns. A pair of vertically-oriented frame members are attached to a supporting bracket mechanism on the column or pole. Semi-circular panel members are positioned around the pole or column and secured at their edges to the frame members. The panel members are shipped and packaged in flat condition and bent into their final semi-circular shapes at the installation site. Retainer clip members are attached to the edges of the panel members in order to hold them securely in place in the frame members. In alternate embodiments, trim cap members can be provided to cover the frame members, and a universal supporting bracket system can be utilized to attach the cladding system to various poles or columns.

26 Claims, 4 Drawing Sheets

ROUND COLUMN CLADDING SYSTEM

TECHNICAL FIELD

The present invention relates to a system for covering columns and poles with a cladding.

BACKGROUND ART

Numerous buildings and places of businesses today have columns or poles which are used to support canopies and other overhead structures. The columns or poles are typically made of posts, box-beams or I-beam construction and typically are not aesthetically pleasing.

Various systems are known for covering poles and columns with various types of cladding or facings, or for forming semi-circular decorative facing structures. Examples of these are shown in U.S. Pat. Nos. 4,823,533 and 4,696,136. Some known systems have panels preformed in their final sizes and shapes. Also, a panel framing system is shown in U.S. Pat. No. 4,040,223.

Known systems often are expensive and/or difficult to manufacture, transport and assemble. The panel members used with such systems often require extensive forming and shaping procedures. Also, some systems utilize a large number of different parts with different sizes and shapes causing difficulty in assembly and installation. Known systems with pre-formed panels are usually difficult and expensive to package and ship to installation sites. Typically, larger and more expensive carton and crating materials are required, thus also causing high freight costs. Further, known systems are often not sufficiently sturdy or durable for their expected purpose and are difficult to replace or change if it becomes necessary to do so.

SUMMARY OF THE INVENTION

It is an object of the present invention to provide an improved covering or cladding system for poles and columns. It is also an object of the present invention to provide a low-cost system for covering poles or columns which also can be easily assembled.

It is a further object of the present invention to provide a column cladding system which has a minimum of parts and is easy to install and replace where necessary. It is a still further object of the present invention to provide a system with mostly flat and/or non-preformed components in order to minimize packaging and freight expenses.

These and other objects and purposes of the present invention are secured by the present invention. The present invention is an improvement over known systems for covering poles and columns and provides a low-cost, easily assembled system.

The present invention includes a structural system, such as supporting brackets, which are attached to the pole or column. Elongated vertical frame members are provided on two sides of the pole or column, substantially 180° apart. The frame members have elongated channels and are secured to the supporting brackets or support mechanism which, in turn, is attached or secured to the pole or column. Flexible panel members formed into half-circles are positioned between the two vertically-oriented frame members. The formed panels create a rigid panel which maintain a curved shape with a true radius.

A plurality of retainer clips are positioned on the edges of the panel members in order to assist in retaining them in the channels in the frame members. The retaining clips are secured to the edges of the panels by barbs or tangs. A protruding spring tab or member is utilized to hold the clips in place in the channels.

Vertically joined panel members are secured together by splice members positioned inside the column cladding system. The splice members hold adjacent panel members together and are secured in place by an adhesive or double-sided tape.

In an alternate embodiment, an edge trim member can be provided which mates with the vertical frame member and covers the vertical frame members. The trim members can help hold the panels in place and also can add to the aesthetics of the cladding. In still another embodiment, the panel members are riveted or otherwise securely affixed to the vertical frame members by fasteners and an edge trim member is provided covering the fasteners from view.

Alternate support mechanisms can be used to secure the frame members to the pole or column. A "universal"-type supporting mechanism can be provided which can accommodate poles and columns of various sizes and cross-sectional shapes.

Still another alternative system uses a raised edge or tab member along the edges of the panel member instead of retainer clips.

Other features and benefits of the present invention will become apparent from the following description of the invention, when viewed in accordance with the attached drawings and appended claims.

BEST MODES FOR CARRYING OUT THE INVENTION

Figure 1:
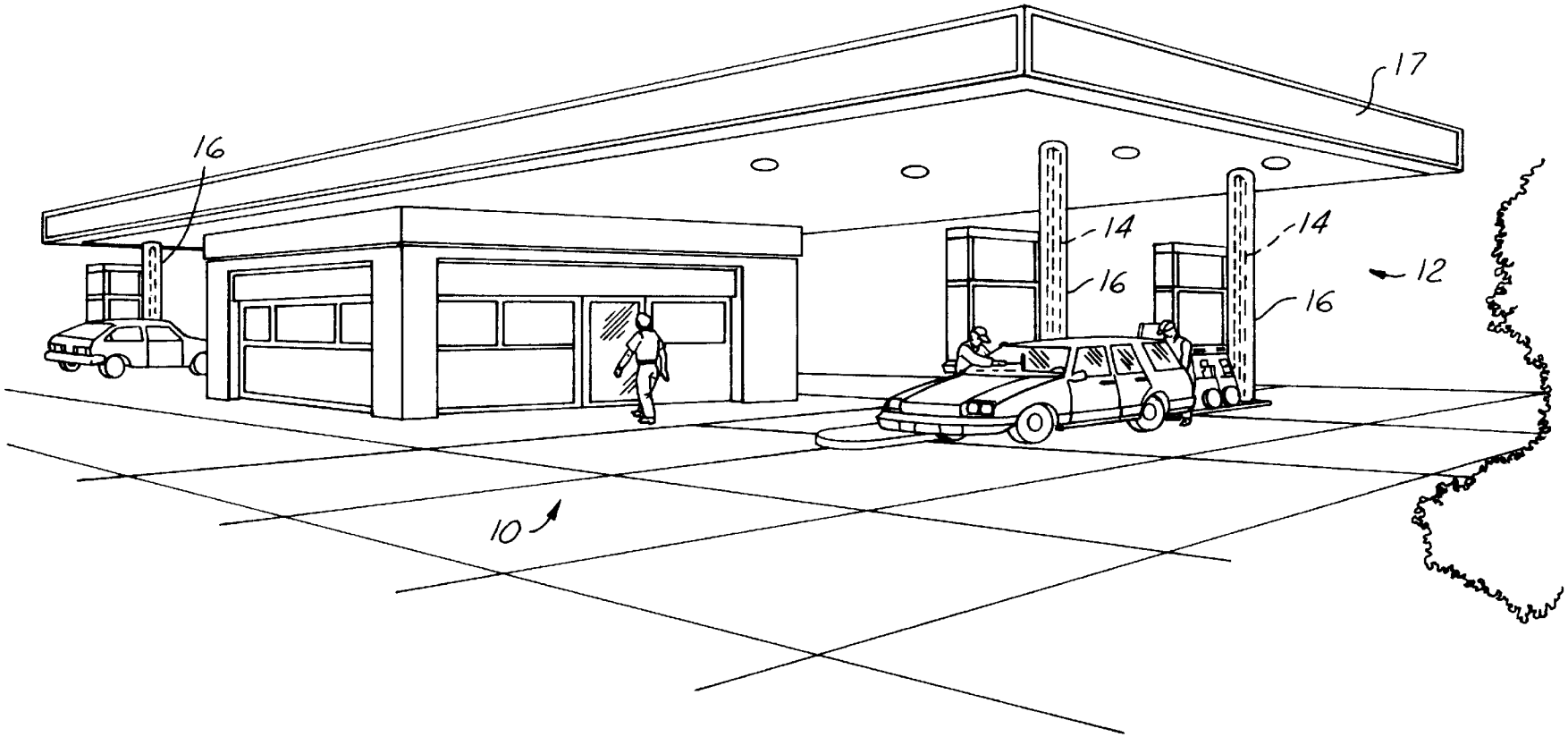
FIG. 1 illustrates a place of business having poles and/or columns.

A preferred embodiment of the present invention is shown in FIGS. 1–6. The present invention provides a unique cladding or covering system for a pole, column, or the like, and is referred to generally by the reference numeral 10.

The present invention has possible use in covering poles, columns, and the like at places of business, such as a service station 12. The poles or columns 14 support a canopy or roof structure 17 at the business. The present invention provides a cladding or covering member 16 which is positioned around the poles, columns, and the like in order to protect and hide them from view.

The cladding system 16 in accordance with the present invention comprises a plurality of circular cladding members 18 which are positioned around the pole or column 14. Each of the cladding members 18 comprises a pair of semi-circular panel members 20 which are positioned around the pole or column 14 and attached to a support system, as shown in the drawings.

Figure 2:
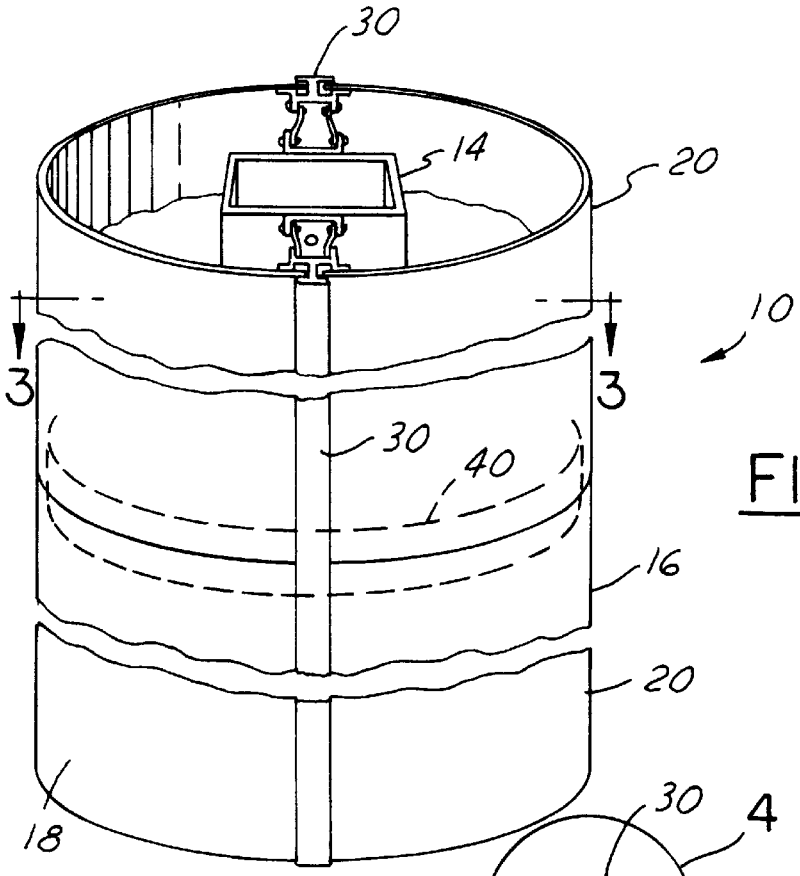
FIG. 2 illustrates use of the present invention on a pole or column.
Figure 3:
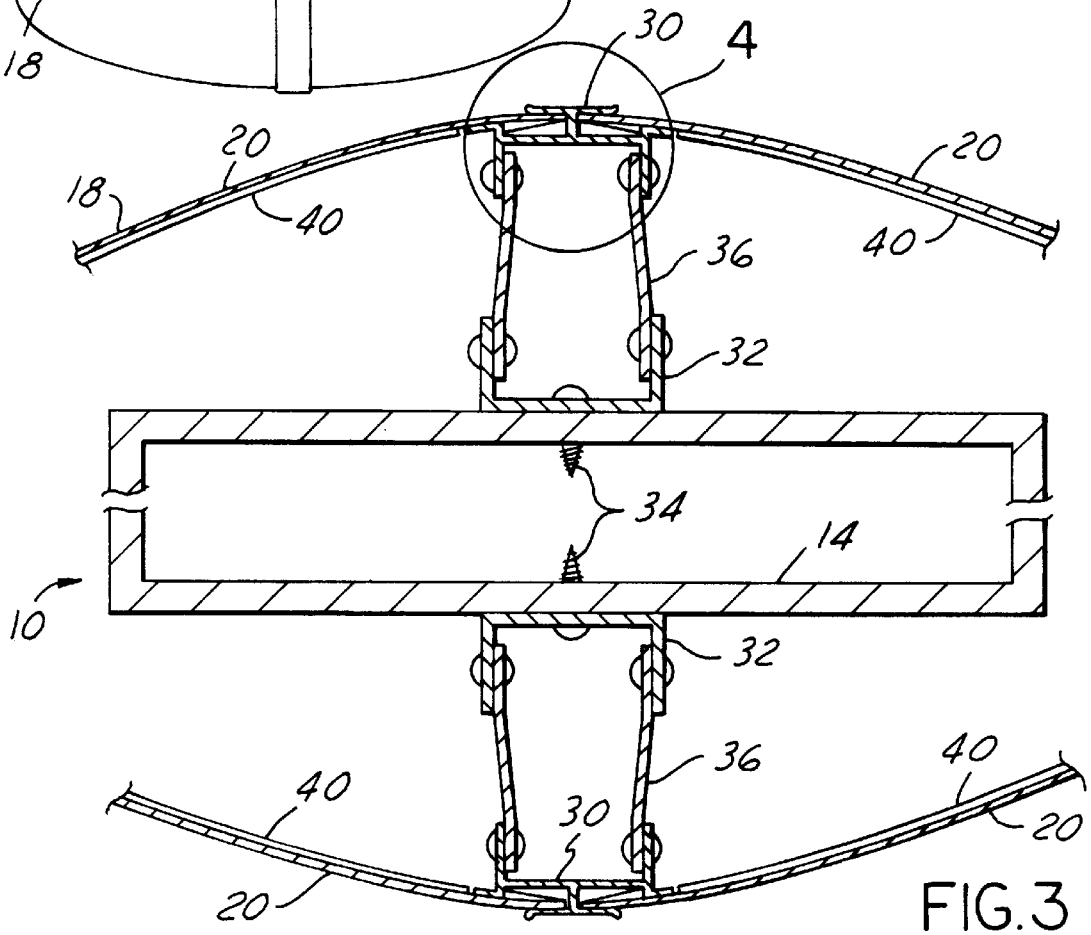
FIG. 3 is a cross-sectional view of the subject matter of FIG. 2, with the cross-section being taken along the line 3—3 in FIG. 2 and in the direction of the arrows.

In this regard, the pole, column, or the like can be of any conventional type, such as a cylindrical post, a metal box-beam column (as shown in FIGS. 2 and 3), an I-beam, or other structural member typically in use today. Also, the poles, columns, or the like can have any cross-sectional size and shape. Preferably, however, the present invention is used with columns 14–28 inches in diameter, and specifically about 18 inches in diameter. In order to secure or attach the present invention to a post or column, the system shown in FIG. 3 is preferred for box-type columns and I-beam columns, while the system shown in FIG. 8 has more universal applicability and can be used with posts or columns of virtually any cross-section, including round and non-uniformly shaped.

The panel members 20 used in accordance with the present invention are preferably made from a plastic material, such as high impact ABS material. Also, the panel members 20 preferably have a coating or layer on them which provides UV protection and a high gloss finish. One preferred panel system utilizes materials made by a co-extrusion process with the panel members being formed from a high impact ABS with a thin clear high gloss acrylic layer on them. The pigmentation is included in the ABS material and provides the desired coloration for the cladding system. Alternatively, the outer surfaces can have a textured, satin or matte finish, or any other desired finish.

Two panel members are attached in a circular configuration around the circumference of the pole or column 14 by a pair of elongated frame members 30. The members 30 are preferably made from an extruded aluminum material and are provided in sufficient lengths to cover the entire height of the post or column.

A pair of vertically oriented frame members 30 are positioned 180° apart on opposite sides of the post or column. This is shown in FIGS. 2 and 3. In a preferred embodiment, the frame members 30 are secured to U-shaped bracket members 32 which are fixedly attached to the pole or column 14. The bracket members 32 are attached to the post or column members 14 in any conventional manner, such as by conventional fasteners 34 (as shown in FIG. 3). If necessary, extender members 36 can be utilized to connect the U-shaped bracket members 32 to the extrusion members 30 if the pole or column 14 is relatively small in size and/or diameter, or the column cladding system 16 is sufficiently larger in size and/or diameter.

The vertical frame members should have sufficient rigidity and strength to securely hold the panel members in place. Preferably, the frame members are provided with sufficient strength to allow mounting of various service station accessories on them, such as windshield washing stations, sign brackets, and the like. In this regard, a representative bracket or mounting member for this purpose is shown in phantom lines in FIG. 7 and designated by the reference numeral 35.

Since posts or columns for buildings are typically 10–20 feet in height, and the panel members 20 are typically only about 5–6 feet in height, it is necessary to splice together several cladding members 18 along the height of the post or column 14. In order to splice adjacent column cladding members 18 together, joint or splice back-up panel members 40 are positioned inside each of the seams or joints. These joint panel members 40 are secured to the inside surfaces of the panel members 20 by double-sided tape, gluing, or the like. The joint back-up panel members 40 prevent light from being visible through the joints or cracks between adjacent panels and also retain the cladding members 18 tightly together.

Figure 4:
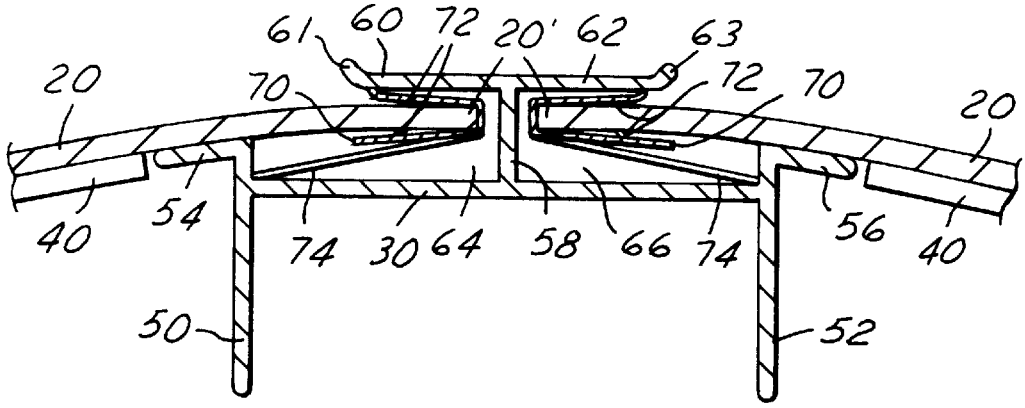
FIG. 4 is an enlarged view of the vertical frame member showing adjacent panels being secured in place in accordance with the present invention.
Figure 5:
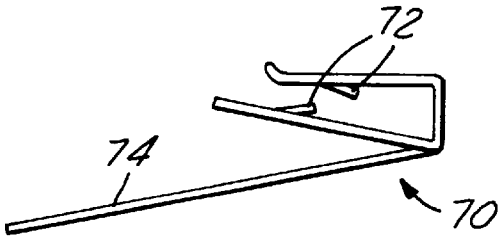
FIGS. 5 and 6 are plan and perspective views, respectively, of a retainer clip for use with the present invention.
Figure 6:
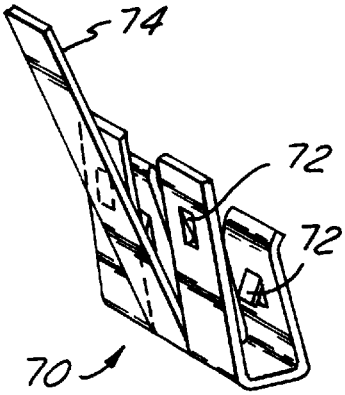

As particularly shown in FIG. 4, the frame members 30 each have a pair of leg members 50 and 52 which are used for attaching the extrusion members 30 to the pole or column, as well as a pair of flange members 54 and 56 which are used to support the panel members 20 adjacent their outer edges. The frame members 30 also have a T-shaped central member 58 with a pair of outwardly extending flanges 60 and 62 which are used to cover and help secure the edges 20' of the panel members 20. The flanges 60 and 62 of the T-shaped member 58 form two elongated channels 64 and 66 in the frame member 30. The edges 20' of the panel member 20 are positioned in the channels 64 and 66 along with the retaining clip members 70, as discussed below.

A plurality of U-shaped retaining clip members 70 are secured to the edges 20' of each of the panel members 20 and are used to fixedly secure the panel members in the frame members 30. The clip members 70 are preferably of the size and shape shown in FIGS. 4–6, although it is understood that other conventional retaining clip members could be utilized so long as they perform and fulfill substantially the same objects and purposes of the retaining clip member 70 shown and discussed herein. The clip members 70 are preferably about 0.50 inches in width and have a plurality of barbs or tangs 72 which are used to hold the clip members tightly on the edges of the panel members 20. The clip members 70 also contain an elongated spring or tab member 74 which is sized to fit within the channels 64 and 66 of the frame members in order to hold the panel members securely in place therein.

As shown in FIG. 4, once the retaining clip members 70 are positioned on the edges of the panel members 20, the panel members 20 can be inserted into the chambers 64 and 66 in the frame members 30 and thereby held tightly and securely in place around the pole or column. Similarly, if a panel member 20 is damaged or needs to be replaced for some reason, the panel member 20 can be relatively easily removed from the frame member 30 and a substitute panel member be positioned in its place.

The clip members 70 are positioned approximately every 18–24 inches along the edges 20' of the panel members 20 and the barbs or tangs 72 are angled in order to dig into the panel material and prevent their removal. The spring tab or finger member 74 extends from the clip member at an angle in order to securely wedge itself in position in the channel. One or more members 74 can be provided on each retainer clip member as desired.

Edges 61 and 63 of flange members 60 and 62 are turned up slightly in order to provide lead-ins for the panel members 20. The turned up edges 61 and 63 allow the edges 20' of the panel members 20 with the retainer clips 70 attached thereto to be inserted more easily into channels 64 and 66 in the frame members 30.

The size and shape of the retainer clip members 70 relative to the flanges 60 and 62 and the channels 64 and 66 in the frame member 30 are such that the retaining clip members 70 are hidden from view behind the flanges 60 and 62. In this manner, a secure cladding system for poles and columns is provided which also presents an attractive and aesthetic appearance.

As indicated earlier, the frame members 30 are preferably made from an extruded aluminum material, although other materials of similar durability and strength could be utilized. The panel members 20 are preferably on the order of 0.080 to 0.100 inches in thickness.

Figure 7:
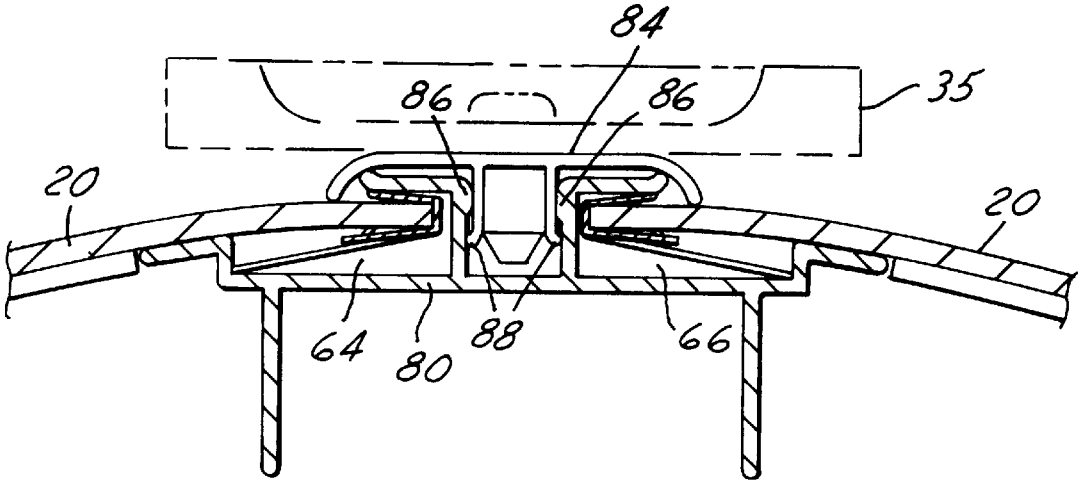
FIG. 7 illustrates an alternate embodiment of the present invention.

FIG. 7 shows an alternative embodiment of the invention. In this embodiment, the frame member 80 has an elongated slot or channel 82 positioned between the channels 64 and 66. In addition, a trim cap member 84 is provided and tightly snapped into the channel 82 as shown. In this regard, in order to securely hold the trim cap member 84 in place, mating ridge members 86 and 88 are provided on the frame member and cap member, respectively.

With the embodiment shown in FIG. 7, the cap member 84 can be made from the same material as the panel members 20, thus providing a continuous cladding system of the same material entirely around the circumference of the pole or column being covered. The outer edges of the trim cap member can also be used to abut the panel members 20, assist in holding them securely in place, and minimize spaces between the flanges 60' and 62' and the outer surface of the panel members.

Figure 8:
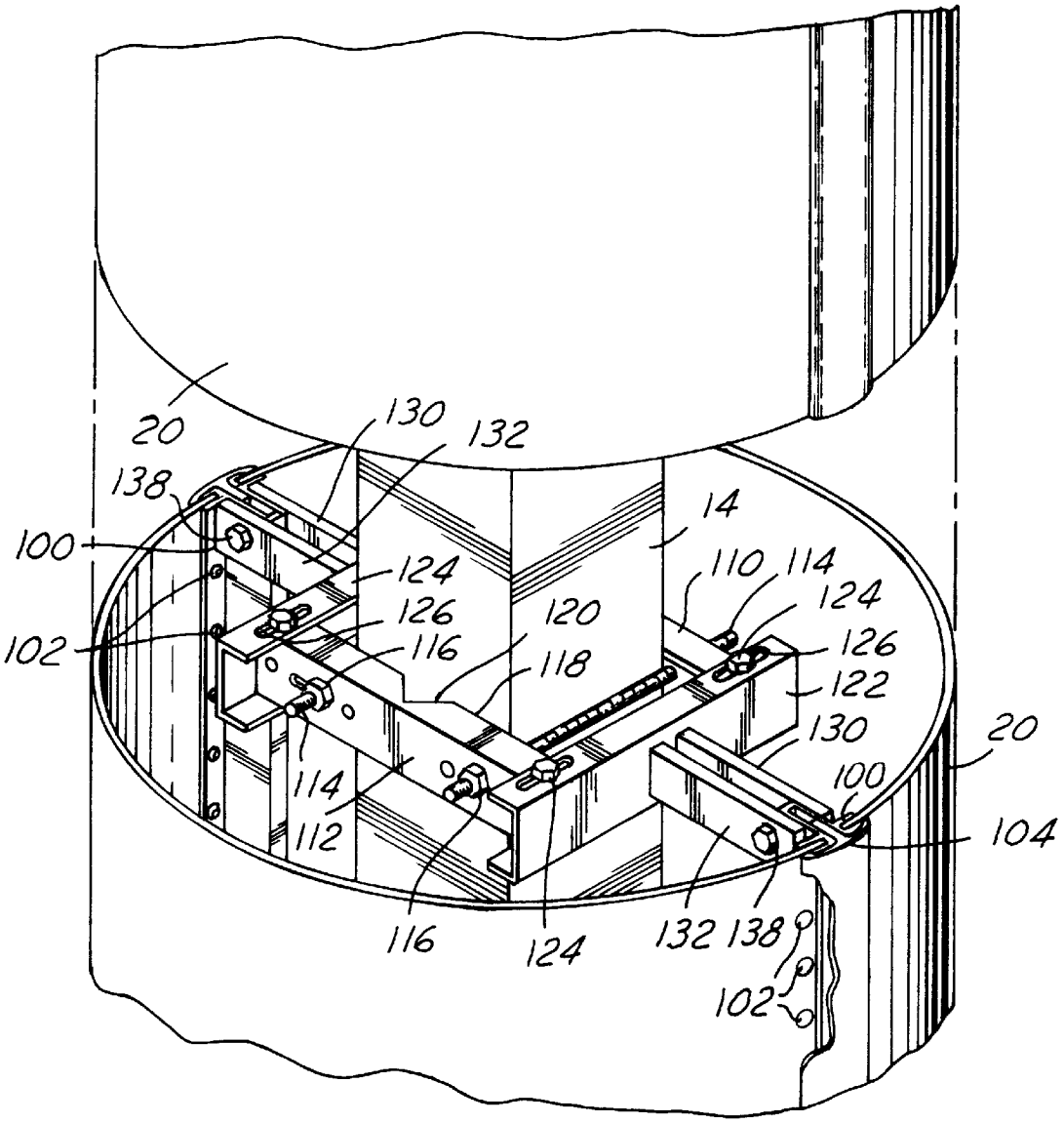
FIG. 8 illustrates still another alternate embodiment of the present invention.

FIG. 8 shows still another embodiment of the present invention. In this embodiment, the frame members are essentially U-shaped channel members 100 and are secured to the edges of the panel members 20 by a plurality of small rivets 102 or other conventional fasteners. A trim cap member 104 is positioned in the frame member 100 in order to cover the fasteners 102 and hide them from view.

The supporting bracket system used with the embodiment shown in FIG. 8 is "universal" and thus adaptable for covering all sizes, types, and cross-sectional shapes of poles and/or columns. A pair of U-shaped bracket members 110 and 112 are held tightly together by threaded fasteners 114. The threaded fasteners 114 are secured to the bracket members 110 and 112 by a plurality of nuts or fastening members 116. The bracket members 110 and 112 have straight edges 118 for accommodating certain sizes and shapes of poles or columns, as well as notches 120 for accommodating corners of pole members or round poles or columns.

An additional pair of U-shaped brackets 122 and 124 are attached to the ends of bracket members 110 and 112 forming a box-like configuration around the pole or column 14. The bracket members 122 and 124 are secured to the bracket members 110 and 112 by a plurality of bolts or other fasteners 124. The bolts or fasteners 124 are positioned in slotted openings 126 in the bracket members 122 and 124 in order to accommodate tightening and loosening of the bracket members 110 and 112 where necessary.

A pair of projecting support members 130 and 132 are attached to each of the support brackets 122 and 124. The support members 130 and 132 in turn are secured to the U-shaped frame members 100 in any conventional manner, such as by bolts or fasteners 138.

With the supporting and mounting system shown in FIG. 8, a wide variety of cross-sectional sizes and shapes of poles and columns 14 can be accommodated with the cladding system.

Figure 9:
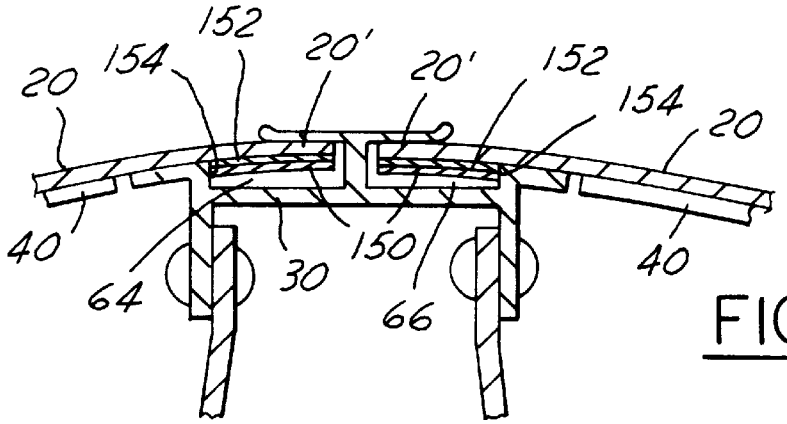
FIG. 9 illustrates a further alternate embodiment of the present invention.

A further embodiment of the invention is shown in FIG. 9. In this embodiment, the retaining clips are replaced with elongated edge or tab members 150. The tab members 150 are positioned along the edges 20' of the panel members 20 and secured in place by double-sided tape 152 or any other comparable means, such as glue, heat bonding, or the like. One of the edges or corners 154 of the tab members 150 is adapted to contact and mate with a wall or surface of the channels 64 and 66 in order to hold the panel members 20 securely in place in the frame members 30. The tab members 150 on each of the panel members can be one single elongated member positioned the full length of the edge of each panel members, or the tab members 150 can be comprised of a plurality of shorter tab members aligned along the edges.

While the best modes for carrying out the invention have been described in detail, those familiar with the art to which this invention relates will recognize various alternative designs and embodiments for practicing the invention as defined by the following claims.

What is claimed is:

1. A cladding system for a column at an installation site comprising:

at least one support bracket mechanism adapted to be attached to the column;

a pair of vertically-oriented elongated frame members affixed to said support bracket mechanism and positioned on opposite sides of the column;

a plurality of panel members positioned around said columns in semi-circular shapes and attached to said frame members; and at least one retainer clip member attached to each of said panel members to assist in securing said panel members to said frame members;

wherein said panel members are manufactured, packaged and shipped to the installation site in substantially flat conditions and bent into their final semi-circular shapes upon installation.

2. The cladding system of claim 1 further comprising a trim cap member attached to each of said frame members.

3. The cladding system of claim 1 further comprising said frame members each having at least one channel member, and said retainer clip members being positioned in said channel members.

4. A cladding system for a column at an installation site comprising:

at least one support bracket mechanism for attachment to the column;

a pair of vertically-oriented elongated frame members affixed to said support bracket mechanism and positioned on opposite sides of the column;

a plurality of panel members positioned around said column and attached to said frame members; and a trim cap member attached to each of said frame members;

wherein said panel members are manufactured, packaged and shipped to the installation site in substantially flat conditions and bent into shapes around the column upon installation.

5. The cladding system of claim 4 further comprising at least one retainer clip member attached to each of said panel members to assist in securing said panel members to said frame members.

6. The cladding system of claim 5 further comprising said frame members each having at least one channel member and said retainer clip members being positioned in said channel members.

7. A cladding system for a column at an installation site comprising:

at least one support bracket mechanism adapted to be attached to the column;

a pair of vertically-oriented elongated frame members affixed to said support bracket mechanism and positioned on opposite sides of the column;

a plurality of panel members positioned around said column and attached to said frame members;

at least one retainer clip member attached to each of said panel members to assist in securing said panel members to said frame members; and said frame members each having at least one channel member, said retainer clip members being positioned in said channel members;

wherein said panel members are manufactured, packaged and shipped to the installation site in substantially flat conditions and bent into shapes around the column upon installation.

8. The cladding system of claim 7 further comprising a trim cap member attached to each of said frame members.

9. A cladding system for a column at an installation site comprising:

at least one support bracket mechanism for attachment to the column;

at least two vertically-oriented elongated frame members affixed to said support bracket mechanism and positioned at spaced apart locations around the column;

a plurality of panel members positioned around the column and attached to said frame members; and at least one retainer clip member attached to each of said panel members to assist in securing said panel members to said frame members.

10. The cladding system of claim 9 further comprising a trim cap member attached to each of said frame members.

11. The cladding system of claim 9 further comprising channel members in each of said frame members, and said retainer clip members being positioned in said channel members.

12. The cladding system of claim 9 wherein a pair of frame members are provided, said frame members being positioned on opposite sides of the column, and wherein each of said panel members are semi-circular in shape and extend between adjacent frame members.

13. The cladding system of claim 9 wherein said panel members are manufactured, packaged and shipped to the installation site in substantially flat conditions and bent into their final shapes around the column upon installation.

14. The cladding system of claim 13 wherein said final shapes are curved.

15. The cladding system of claim 9 wherein at least two retainer clip members are attached to each of said panel members.

16. The cladding system of claim 9 wherein said retainer clip members contain barbed members thereon to assist in securing them to said frame members.

17. The cladding system of claim 9 wherein said retainer clip members contain elongated tab members thereon to assist in securing them to said frame members.

18. The cladding system of claim 11 wherein said retainer clip members contain barb members thereon to assist in securing them in said channel members.

19. The cladding system of claim 11 wherein said retainer clip members contain elongated tab members thereon to assist in securing them in said channel members.

20. The cladding system of claim 18 wherein said retainer clip members also contain elongated tab members thereon to assist in securing them in said channel members.

21. A cladding system for a column at an installation site comprising:

at least one support bracket mechanism adapted to be attached to the column;

at least two vertically-oriented elongated frame members affixed to said support bracket mechanism and positioned at spaced apart locations around the column;

a plurality of panel members positioned in shapes around the column and attached to said frame members; and at least one retainer tab member attached to each of said panel members to assist in securing said panel members to said frame members.

22. The cladding system of claim 21 further comprising a trim cap member attached to each of said frame members.

23. The cladding system of claim 21 further comprising said frame members each having at least one channel member, and said retainer tab members being positioned in said channel members.

24. The cladding system of claim 21 wherein said panel members are manufactured, packaged and shipped to the installation site in substantially flat conditions and bent into their final shapes upon installation.

25. The cladding system of claim 24 wherein said final shapes are curved.

26. The cladding system of claim 21 wherein a pair of frame members are provided on opposite sides of the column and said panel members are semi-circular in shape.

* * * * *